US005154304A

United States Patent [19]

McAuley

[11] Patent Number: 5,154,304

[45] Date of Patent: Oct. 13, 1992

[54] DISPLAY PANEL ASSEMBLY

[75] Inventor: William A. McAuley, Lincoln, R.I.

[73] Assignee: Display Creations, Inc., Pawtucket, R.I.

[21] Appl. No.: 632,142

[22] Filed: Dec. 21, 1990

[51] Int. Cl.[5] ..... B42F 15/00

[52] U.S. Cl. ..... 211/59.1; 211/87; 248/222.2; 248/221.3

[58] Field of Search ..... 211/59.1, 94, 87; 52/36; 248/222.2, 221.3, 244, 245, 297.2, 298, 225.2

[56] References Cited

U.S. PATENT DOCUMENTS

| | | | |
|---|---|---|---|
| 542,318 | 7/1895 | Sjoholm | 248/222.2 X |
| 1,419,563 | 6/1922 | Horning | 248/222.2 X |
| 4,509,648 | 4/1985 | Govang et al. | 211/59.1 X |
| 4,598,504 | 7/1986 | Itagaki | 211/87 X |
| 4,708,311 | 11/1987 | Clausen et al. | 248/222.2 |
| 4,726,554 | 2/1988 | Sorrell | 211/59.1 X |
| 4,825,601 | 5/1989 | Halverson | 248/222.2 X |
| 4,882,868 | 11/1989 | Fast | 211/59.1 X |

*Primary Examiner*—Carl D. Friedman
*Assistant Examiner*—Korie H. Chan
*Attorney, Agent, or Firm*—Salter, Michaelson & Benson

[57] ABSTRACT

A display panel assembly includes a display panel and a plurality of hanger members which are releasably receivable in assembled relation with the display panel for supporting articles for display in front thereof. The display panel includes a plate portion having at least one horizontally extending slot therein, and an engagement portion on the rear side of the plate portion adjacent each of the slots. Each of the hanger members includes a hanger portion which is adapted for supporting an article for display in front of the display panel and a support portion which is releasably receivable through one of the slots in the plate portion for releasably securing the support portion thereof in the adjacent engagement portion of the display panel.

14 Claims, 1 Drawing Sheet

DISPLAY PANEL ASSEMBLY

BACKGROUND AND SUMMARY OF THE INVENTION

The instant invention relates to display apparatus and more particularly to a display panel assembly comprising a display panel and a hanger member which is readily and easily releasably receivable in engagement on the display panel.

While a number of different types of display panel assemblies have been heretofore available for supporting various types of articles in retail displays, most of the heretofore available display panel assemblies have either been incapable of being readily and easily adapted for specific applications or they have been incapable of effectively and attractively supporting articles in retail displays. For example, display assemblies comprising permanently mounted hanger elements have often been found to be unsatisfactory because they are incapable of being adapted to meet the needs of various specific applications. Other types of display assemblies, such as peg board type assemblies, have been found to be unsatisfactory because they are relatively unattractive and they prone to becoming inadvertently disassembled. Accordingly, there is a recognized need for an effective and attractive display assembly which is capable of supporting articles in a retail display and which is also capable of being readily adapted to meet the needs of various specific retailers.

The instant invention provides an effective display assembly comprising a display panel and a hanger member which is detachably securable in various positions on the display panel so that it can be effectively utilized for displaying various articles in front of the display panel. More specifically, the display panel assembly of the subject invention includes a display panel comprising a plate portion which is adapted to be mounted in a substantially vertical disposition and which has at least one elongated, horizontally extending slot formed therein. The hanger member includes a hanger portion for receiving and supporting an article for display, and a support portion which is receivable in a slot in the plate portion so that it is supported on the lower edge of the slot and extends rearwardly beyond the rear side of the plate portion. The display panel further includes engagement means comprising a pair of spaced engagement sections which extend rearwardly from the rear side of the plate portion for engaging the upper side of the support portion in order to prevent the support portion from pivoting about the lower edge of the slot and retaining means for releasably retaining the support portion in engagement in the slot. The support portion preferably includes spaced first and second upper surface portions and an upstanding finger which extends upwardly between the first and second upper surface portions so that it is receivable in engagement between the first and second engagement sections to horizontally position the support portion in the slot when the support portion is in the assembled position thereof. The engagement means preferably further includes a bottom wall which extends rearwardly from the rear side of the plate portion adjacent the lower edge of the slot and the lower surface of the support portion preferably rests on the bottom wall when the support portion is received in the slot. The engagement means preferably further includes a rear wall which extends upwardly from the bottom wall in rearwardly spaced relation to the plate portion and the engagement means is preferably received in engagement with the rear wall when the support portion is in the assembled position thereof. The retaining means for retaining the support portion in the slot preferably includes a pair of latch members which are releasably receivable in engagement with the plate portion for retaining the support portion in the assembled position thereof. The latch members are preferably operative for engaging the rear side of the plate portion along the upper edge of the slot and they are preferably resiliently deflectable downwardly for releasing the latch members from engagement with the plate portion. Further, the latch members preferably include leg portions which are engageable with the lower edge of the slot for preventing the latch members from being damaged by deflecting them downwardly by excessive amounts.

It has been found that the display panel assembly of the instant invention can be effectively adapted to meet the needs of various retailers and that it can be effectively utilized for displaying various articles. Specifically, it has been found that because of the manner in which the support portion is readily and easily releasably receivable in engagement in the slot in the display panel the hanger member can be readily assembled in various different locations on the display panel. Further, a plurality of different hanger members can be assembled on the display panel to adapt the panel for various specific applications. In addition, because of the effective and positive manner in which the support portion is receivable in engagement in a slot in the display panel the hanger member is not prone to becoming inadvertently disengaged therefrom. Hence, the display panel assembly of the instant invention provides a relatively simple and effective means for supporting articles which can be adapted to meet the needs of various different retailers.

The closest prior art to the subject invention of which the applicant is aware is disclosed in the U.S. Pat. to Duarte No. 4,826,022. However, since the display panel assembly of the subject invention includes hanger members which are adapted to be supported in an entirely different manner from the corresponding elements in the Duarte display panel assembly, the U.S. Patent to Duarte is believed to be of only general interest with respect to the subject invention.

Accordingly, it is a primary object of the instant invention to provide an effective display panel assembly which is adapted to be modified to meet the needs of various specific retailers.

Another object of the instant invention is to provide an effective display panel assembly comprising a display panel and a hanger member which is readily and easily detachably securable on the display panel.

Another object of the instant invention is to provide an effective display panel assembly comprising one or more hanger members which can be readily and easily secured on a display panel in an effective and positive manner.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 5 is a sectional view taken along the line 5—5 in FIG. 1; and

DESCRIPTION OF THE INVENTION

Figure 1:
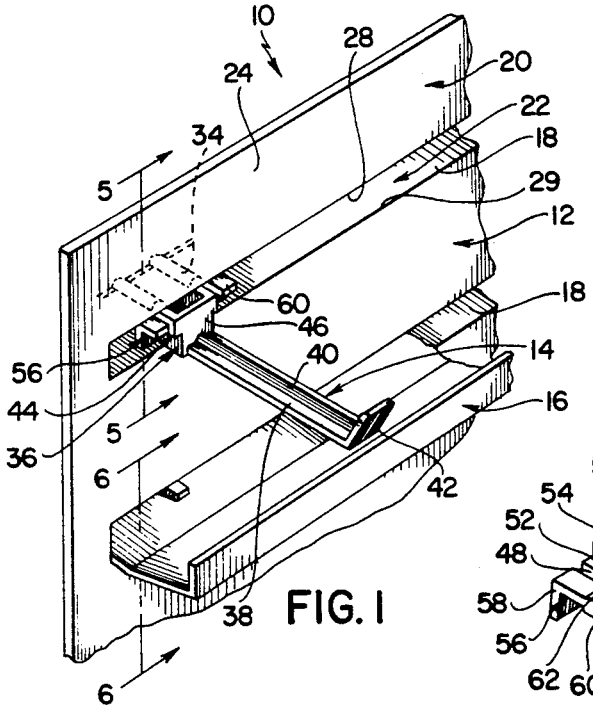
FIG. 1 is a perspective view of the display panel assembly of the instant invention.
Figure 2:
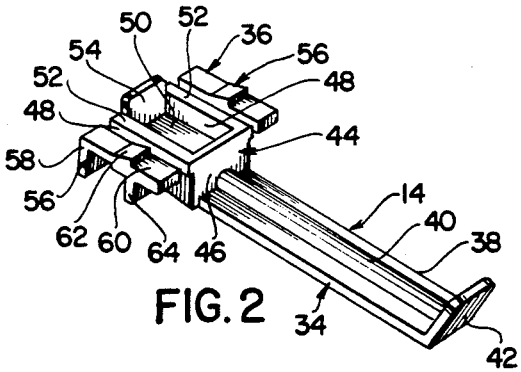
FIG. 2 is an enlarged perspective view of one of the hanger members thereof.

Referring now to the drawing, the display panel assembly of the instant invention is illustrated in FIG. 1 and generally indicated at 10. The displaced panel assembly 10 comprises a display panel generally indicated at 12, a first hanger member generally indicated at 14, and a second hanger member generally indicated at 16. The display panel 12 is adapted to be mounted in a substantially vertical disposition and it has a plurality of elongated horizontally extending slots 18 therein. The hanger members 14 and 16 are receivable in the slots 18 so that the hanger members 14 and 16 are releasably secured in the assembled positions thereof illustrated in FIG. 1 to enable the hanger members 14 and 16 to be utilized for supporting articles for display in front of the panel 12.

The display panel 12 is preferably integrally molded from a suitable durable plastic material and it includes a front plate portion generally indicated at 20 and a plurality of engagement portions generally indicated at 22. The plate portion 20 has front and rear sides 24 and 26, respectively, and the slots 18 which are substantially horizontally oriented extend through the plate portion 20 as illustrated. Each of the slots 18 has upper and lower edges 28 and 29, respectively, and an engagement portion 22 is formed on the rear side of the plate portion 20 adjacent each of the slots 18. Each of the engagement portions 22 includes a bottom wall 30 which extends integrally rearwardly and slightly upwardly from the plate portion 20 adjacent the lower edge 29 of the respective slot 18 thereof, a rear wall 32 which extends upwardly from the bottom wall 30 thereof in rearwardly spaced relation to the plate portion 20, and a plurality of spaced pins 34 which extend between the rear wall 32 and the plate portion 20 so that they are joined to the plate portion 20 adjacent the upper edges 28 of the respective slots 18 thereof. The pins 34 have substantially flat bottom surfaces 34*a* which angle slightly downwardly in their rearward extents.

The first hanger member 14 is illustrated in FIGS. 1 through 5 and it comprises a hanger portion generally indicated at 35 and a support portion generally indicated at 36. The hanger portion 35 includes an elongated main portion 38 having a longitudinally extending stiffening rib 40 thereon and an upturned terminal end portion 42. As herein embodied the hanger portion 35 is adapted for supporting pre-packaged items, such as carded jewelry items and the like thereon, although it will be understood that the hanger portion 35 can also be adapted for receiving and supporting various other types of items on the display panel 12. The support portion 36 is preferably integrally molded with the hanger portion 35 from a suitable durable plastic material and it includes a body portion 44 which is slightly vertically tapered in its rearward extent and which comprises a front wall 46, a pair of spaced side walls 48, and a bottom wall 50. The side walls 48 have upper surfaces 52 and the bottom side of the bottom wall 50 defines the lower surface of the body portion 44. The upper surfaces 52 and the lower surfaces of the bottom wall 50 are spaced by a distance which is slightly less than the vertical height of the slots 18, and an upstanding finger 54 extends upwardly between the side walls 48 above the upper surfaces 52.

Also included in the support portion 36 is a pair of side latch assemblies which are generally indicated at 56. The latch assemblies 56 are integrally formed with the body portion 44 and they are positioned in outwardly spaced relation to the side walls 48. Each of the latch assemblies 56 includes a rear wall portion 58 which is integrally attached to the adjacent side wall 48, an upper latch arm 60 having a latch element 62 thereon and a stop leg 64. Each of the upper latch arms 60 extends integrally forwardly from the respective rear wall 58 in outwardly spaced relation to the respective side wall 48 thereof, and hence each of the latch arms 60 is resiliently downwardly pivotable slightly relative to the body portion 44. The latch elements 62 are of wedge shaped configuration and they are formed on the upper surfaces of the latch arms 60. The latch arms 60 have substantially vertical faces which face forwardly toward the hanger portion 35 and the stop legs 64 extend downwardly from the latch arms 60 beneath the latch elements 62.

Figure 3:
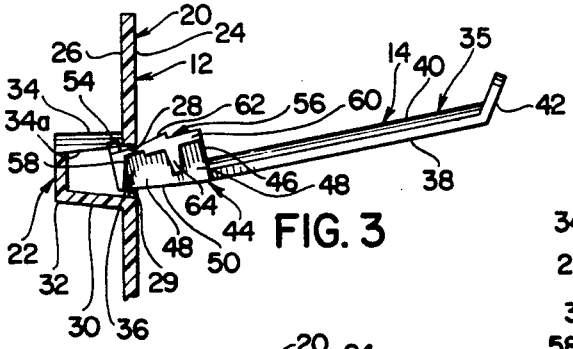
FIGS. 3 through 5 are sequential sectional views illustrating the assembly of the hanger member on the display panel.
Figure 4:
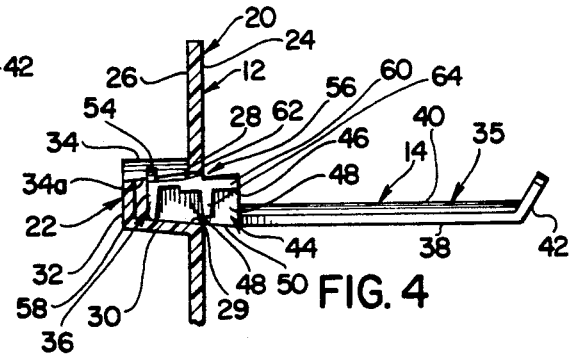
Figure 5:
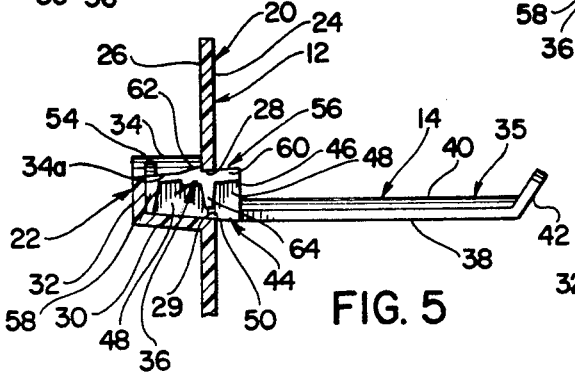

Referring now to FIGS. 3 through 5, the manner in which the hanger element 14 is assembled with the display panel 12 is illustrated. In this regard, the support portion 36 is inserted into one of the slots 18 by tilting the hanger element 14 upwardly so that the finger 54 passes through the slot 18 to position it between a pair of the pins 34. The hanger element 14 is then advanced rearwardly until the support portion 36 engages the end wall 32. As the support portion 36 is advanced rearwardly through the slot 18 so that it passes into the engagement portion 22, the latch elements 62 thereof engage the upper edge 28 of the slot 18 causing the latch arms 60 to be pivoted downwardly. When the support portion 36 has been advanced into the engagement portion 22 to a point where the finger 54 is closely adjacent to the end wall 32, the latch elements 62 pass completely through the slots 18 so that the latch arms 60 are returned to their normal positions and the front faces of the latch elements 62 engage the rear surface 26 of the plate portion 20 to releasably lock the support portion 36 in the engagement portion 22. When the hanger member 14 has been assembled in the slot 18 in this manner the upper surfaces 52 engage the lower surfaces 34*a* of the pins 34 to prevent the hanger member 14 from pivoting on the lower edge 29, and the finger 54 thereof is received between a pair of the pins 34 so that the finger 54 prevents the hanger member 14 from being shifted laterally in the slot 18.

Figure 6:
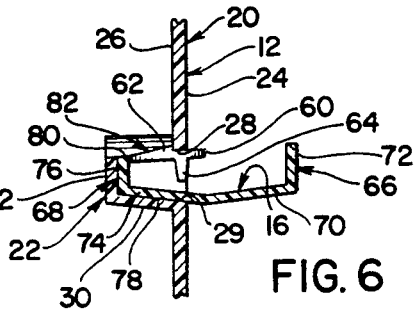
FIG. 6 is a sectional view taken along the line 6—6 in FIG. 1.

Referring now to FIGS. 1 and 6, the second hanger member 16 is more clearly illustrated. The second hanger member 16 includes an elongated hanger portion generally indicated at 66, and an elongated support portion generally indicated at 68 which is integrally molded with the hanger portion 66. The hanger portion 66 includes an elongated bottom wall 70 and an upstanding front wall 72 which cooperate to define a relatively wide hook-like structure for supporting articles thereon. The support portion 68 includes an elongated bottom wall 74 which extends integrally from the bottom wall 70, and an upstanding rear wall 76 which extends integrally upwardly from the bottom wall 74. The bottom wall 74 and the rear wall 76 cooperate to define a body-like structure and the bottom wall 74 has a bottom surface 78, whereas the end wall 76 has an upper surface 80. Also included in the support portion 68 is a plurality of latch assemblies 82, each of which includes a latch arm 60, a latch element 62 and a stop leg 64. The latch assemblies 82 are operative in the same manner as the latch assemblies 56 for releasably securing the second hanger member 16 in one of the slots 18 in the manner illustrated. Further, by depressing the latch arms 60 of the latch assemblies 82 downwardly, the latch elements 62 thereof can be disengaged from the rear side 26 of the plate portion 20 to remove the second hanger member 16 from the display panel 12. In this connection, as the latch arms 60 of the latch assemblies 82 are depressed downwardly the stop legs 64 thereof prevent the latch arm 60 from pivoting downwardly by an amount which could cause damage thereto.

It is seen therefore that the instant invention provides an effective display panel assembly. The support members 14 and 16 are readily and easily releasably receivable in the respective slots 18 thereof so that they can be detachably secured to the panel 12. Specifically, the support portions 36 and 68 cooperate to effectively releasably secure the hanger members 14 and 16 in the slots 18 so that the hanger members 14 and 16 are positively secured to the panel 12 in a manner which allows them to be removed or repositioned as needed. Accordingly, it is seen that the instant invention represents a significant advancement in the art relating to display apparatus and that it has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display panel assembly comprising a display panel and a hanger member, said display panel including a plate portion having front and rear sides and upper and lower ends and having an elongated substantially horizontally extending slot therein, said slot having opposed upper and lower edges, said hanger member including a hanger portion for receiving and supporting an article for display thereon and a support portion, said support portion including a body portion having upper and lower surfaces, and having a maximum thickness as defined by the maximum distance between said upper and lower surfaces, said body portion upper surface including laterally spaced first and second upper surface portions, said support portion further comprising an upstanding finger extending upwardly between said upper surface portions, said support portion being receivable in said slot from the front side of said plate portion so that it is positioned in an assembled position, wherein the lower surface of said body portion is supported on said lower edge, and wherein said body portion extends rearwardly beyond the front side of said plate portion, the maximum thickness of said body portion being less than the vertical distance between the upper and lower edges of said slot, said display panel further including engagement means engaging both of said first and second upper surface portions at points which are spaced rearwardly from the rear side of said plate portion when said support portion is in the assembled position for preventing said hanger member from pivoting about said lower edge of said slot, said engagement means including spaced first and second engagement sections, said finger being received between said first and second engagement sections to laterally position said support portion in said slot when said support portion is in the assembled position thereof, said hanger member further comprising retaining means releasably engaging said display panel for retaining said hanger member in the assembled position thereof.

2. In the display panel assembly of claim 1, said first and second engagement sections comprising first and second spaced pins extending rearwardly from the rear side of said plate portion adjacent the upper edge of said slot.

3. A display panel assembly comprising a display panel and a hanger member, said display panel including a plate portion having front and rear sides and upper and lower ends and having an elongated substantially horizontally extending slot therein, said slot having opposed upper and lower edges, said hanger member including a hanger portion for receiving and supporting an article for display thereon and a support portion, said support portion including a body portion having upper and lower surfaces, and having a maximum thickness as defined by the maximum distance between said upper and lower surfaces, said support portion being receivable in said slot from the front side of said plate portion so that it is positioned in an assembled position, wherein the lower surface of said body portion is supported on said lower edge, and wherein said body portion extends rearwardly beyond the rear side of said plate portion, the maximum thickness of said body portion being slightly less than the vertical distance between the upper and lower edges of said slot, said display panel further including engagement means engaging said upper surface of said body portion at a point which is spaced rearwardly from the rear side of said plate portion when said support portion is in the assembled position thereof for preventing said hanger member from pivoting about said lower edge of said slot, said engagement means comprising a bottom wall extending rearwardly from the rear side of said plate portion adjacent the lower edge of said slot, said body portion lower surface engaging said bottom wall when said support portion is received in the assembled position thereof, said hanger member further comprising retaining means releasably engaging said display panel for retaining said hanger member in the assembled position thereof.

4. In the display panel assembly of claim 3, said engagement means further comprising a rear wall extending upwardly from said bottom wall in rearwardly spaced relation to said plate portion, said support portion engaging said rear wall when said support portion is in the assembled position thereof.

5. In the display panel assembly of claim 4, said support portion further comprising an upstanding finger extending upwardly between said upper surface portions, said engagement means including spaced first and second engagement sections, said finger being received between said first and second engagement sections to horizontally position said support portion in said slot when said support portion is in the assembled position thereof.

6. In the display panel assembly of claim 5, said first and second engagement sections comprising first and second spaced pins extending rearwardly from the rear side of said plate portion adjacent the upper edge of said slot to said rear wall.

7. In the display panel assembly of claim 6, said retaining means comprising a latch member releasably engaging said plate portion for retaining said support portion in the assembled position thereof.

8. In the display panel assembly of claim 7, said latch member engaging the rear side of said plate portion along the upper edge of said slot for retaining said support portion in the assembled position thereof.

9. In the display panel assembly of claim 8, said retaining means further comprising a pair of said latch members engaging the rear side of said plate portion along the upper edge of said slot for retaining said support portion in the assembled position thereof.

10. In the display panel assembly of claim 9, said latch member being resiliently deflectable downwardly for disengaging said latch member from said plate portion, said latch member including a downwardly extending leg portion which is engageable with the lower edge of said slot for preventing excessive downwardly deflecting of said latch member.

11. A display panel assembly comprising a display panel and a hanger member, said display panel including a plate portion having front and rear sides and upper and lower ends and having an elongated substantially horizontally extending slot therein, said slot having opposed upper and lower edges, said hanger member including a hanger portion for receiving and supporting an article for display thereon and a support portion, said support portion including a body portion having upper and lower surfaces, and having a maximum thickness as defined by the maximum distance between aid upper and lower surfaces, said support portion being receivable in said slot from the front side of said plate portion so that it is positioned in an assembled position, wherein the lower surface of said body portion is supported on said lower edge, and wherein said body portion extends rearwardly beyond the rear side of said plate portion, the maximum thickness of said body portion being slightly less than the vertical distance between the upper and lower edges of said slot, said display panel further including engagement means engaging said upper surface of said body portion at a point which is spaced rearwardly from the rear side of said plate portion when said support portion is in the assembled position thereof for preventing said hanger member from pivoting about said lower edge of said slot, said hanger member further comprising retaining means releasably engaging said display panel for retaining said hanger member in the assembled position thereof, said retaining means comprising a latch member releasably engaging said plate portion for retaining said support portion in the assembled position thereof.

12. In the display assembly of claim 11, said latch member engaging the rear side of said plate portion along the upper edge of said slot for retaining said support portion in the assembled position thereof.

13. In the display panel assembly of claim 12, said retaining means further comprising a pair of said latch members engaging the rear side of said plate portion along the upper edge of said slot for retaining said support portion in the assembled position thereof.

14. In the display panel assembly of claim 12, said latch member being resiliently deflectable downwardly for disengaging said latch member from said plate portion, said latch member including a downwardly extending leg portion which is engageable with the lower edge of said slot for preventing excessive downwardly deflecting of said latch member.

* * * * *